US007836609B2

(12) United States Patent
Covatch

(10) Patent No.: US 7,836,609 B2
(45) Date of Patent: Nov. 23, 2010

(54) METHOD AND APPARATUS FOR A SHOE WITH IMPROVED CONSTRUCTION

(75) Inventor: Charles E. Covatch, Martinsburg, PA (US)

(73) Assignee: Columbia Insurance Company, Omaha, NE (US)

( * ) Notice: Subject to any disclaimer, the term of this patent is extended or adjusted under 35 U.S.C. 154(b) by 774 days.

(21) Appl. No.: 11/697,925

(22) Filed: Apr. 9, 2007

(65) Prior Publication Data

US 2008/0244934 A1 Oct. 9, 2008

(51) Int. Cl.
*A43B 9/10* (2006.01)
*A43B 9/04* (2006.01)
*A43B 13/28* (2006.01)

(52) U.S. Cl. ..... 36/17 R; 36/12; 36/19 R; 36/17 PW; 12/142 D

(58) Field of Classification Search ..... 36/12, 36/17 R, 17 A, 17 PW, 18, 19 R, 22 R, 16; 12/142 B, 142 C, 142 D
See application file for complete search history.

(56) References Cited

U.S. PATENT DOCUMENTS

| | | | | |
|---|---|---|---|---|
| 1,920,338 | A | 9/1932 | Ayers | |
| 2,416,847 | A | 11/1945 | Rosenzweig | |
| 5,911,491 | A * | 6/1999 | Huff | 36/17 R |
| 6,226,895 | B1 * | 5/2001 | McClelland | 36/17 R |
| 6,601,319 | B1 * | 8/2003 | Clements | 36/17 R |
| 6,647,644 | B2 * | 11/2003 | Liu | 36/17 R |
| 6,754,982 | B2 * | 6/2004 | Reed et al. | 36/30 A |
| 6,802,138 | B2 * | 10/2004 | McManus et al. | 36/28 |
| 2005/0091883 | A1 * | 5/2005 | Davis | 36/76 R |
| 2005/0262728 | A1 | 12/2005 | Robbins | |

* cited by examiner

*Primary Examiner*—Jila M Mohandesi
(74) *Attorney, Agent, or Firm*—St. Onge Steward Johnston & Reens LLC

(57) ABSTRACT

The invention relates to a shoe having a sole with a first part, a second part, and a top surface extending from the first part to the second part. The shoe also includes a welt attached to a localized area of a perimeter of the second part and an upper having an inside and an outside, where the outside is attached to the welt in the second part of the sole and where the inside is attached to the top surface in the first part of the sole.

15 Claims, 7 Drawing Sheets

METHOD AND APPARATUS FOR A SHOE WITH IMPROVED CONSTRUCTION

FIELD OF THE INVENTION

The invention relates to a shoe with enhanced comfort.

BACKGROUND OF THE INVENTION

Welt-type shoes or boots are typically sturdy and resist water, which makes them preferable for outdoor or rigorous environments. As shown in FIG. 1, welt 12 is attached to a perimeter of shoe 10 and stitch 18 passes through rib 16, welt 12, and upper 22 to secure insole 26 and upper 22 to the rest of shoe 10. In this fashion, wear upon stitch 18 is reduced since welt 12 protects stitch 18 from debris or abrasions, which results in a reduction in the likelihood of upper 22 being separated from an outsole placed beneath and attached to midsole 28. Further, a shoe or boot made according to the welt system usually inhibits dirt and other debris from entering the shoe through the attachment of the upper and sole.

Because insole 26, upper 22, and rib 16 are all secured to welt 12 and welt 12 is attached to midsole 28, midsole 28 is generally a rigid and sturdy material to provide a strong enough anchoring mechanism. If midsole 28 is too flexible, stitch 18 or welt 12 may tear away from midsole 28. To improve the comfort of such welted shoes and boots, a cushioning pad may be placed on top of insole 26. However, this may not enhance flexibility and the thickness of the cushioning pad is possibly compromised due to the limited space within the interior of shoe 10. Moreover, since such cushion is customarily of a uniform thickness, additional cushioning at the key impact areas near the heel and forepart of the shoe or boot may be lacking.

Another disadvantage of conventional welted construction is the welt itself, which typically is semi-rigid or rigid to withstand the forces exerted through the stitching and to secure the sole and upper together with extraordinary strength around the entire shoe. Welt 12 may be a strip of leather, reinforced fabric, or hard rubber. Moreover, the stitching is often concentrated, or densely applied, as it extends around the perimeter of welt 12 because a minimal amount of stitching may cause the stitch to fail, and such concentrated stitching possibly contributes to a reduction in flexibility.

A construction built primarily for comfort usually includes soft and contoured midsoles and outsoles, such as generally used in athletic shoes. In these constructions, an upper is typically molded or cemented directly to the outsole, which is usually contoured or shaped to conform to the wearer's foot and to offer a comfortable fit. Typically, the midsole is constructed of a soft material such as polyurethane or ethylvinyl acetate, which is bonded to an outsole of harder wearing material such as rubber or thermoplastic polyurethane. Although these constructions provide comfortable cushioning for the wearer's foot, the soles normally wear quickly and/or the uppers detach from the soles.

Although different constructions exist for either durability or comfort, there is generally no integrated construction that combines both durability and comfort without compromising either.

What is desired, therefore, is a shoe construction that provides both durability and comfort. Another desire is a durable and comfortable shoe that resists wear and inhibits debris from entering the shoe. A further desire is a shoe with enhanced flexibility.

SUMMARY OF THE INVENTION

It is, therefore, an object of the invention to provide a shoe with a welted construction for strength combined with a stitch out construction for comfort and flexibility.

Another object is a shoe that utilizes the stitch out construction in a fore part of the shoe where flexing is typically encountered.

Yet another object is a shoe that includes a comfortable construction yet retains the look and feel of a welted shoe.

These and other objects of the invention are achieved by a shoe having a sole with a first part, a second part, and a top surface extending from the first part to the second part. The shoe also includes a welt attached to a localized area of a perimeter of the second part and an upper having an inside and an outside, where the outside is attached to the welt in the second part of the sole and where the inside is attached to the top surface in the first part of the sole.

In some embodiments, the sole is a midsole. In some of these embodiments, an outsole is attached to the midsole.

In other embodiments, a stitch extends from the outside of the upper to the sole in the first part and another stitch extends from the welt to the sole in the second part of the sole. The shoe also includes an insole with a rib where a stitch attaches the upper to the rib and to the sole in the second part.

In another embodiment, the upper is in contact with the first part around a perimeter of the first part, thereby defining a flattened lip. The flattened lip has a depth defined at least in part by an outermost perimeter and an innermost perimeter around the first part. In some of these embodiments, the welt has a depth similar to the flattened lip.

In another aspect of the invention, a shoe includes a sole having a first part, a second part, and a top surface extending from the first part to the second part. The shoe also has a welt attached to a localized area of a perimeter of the second part, an upper having an inside and an outside, where the outside is attached to the welt in the second part of the sole and where the inside is attached to the top surface in the first part of the sole. An insole placed over the second part, the insole having a rib where the upper is attached to the rib. The shoe also includes a first stitch extending from the rib through the upper and to the welt, a second stitch extending from the welt to the sole, and a third stitch extending from the outer surface of the upper to the sole in the first part to secure the inside of the upper to the first part.

In some embodiments, a fourth stitch extends from the outer surface of the upper through the sole to a bottom of the sole in the first part for securing the upper to the first part.

In other embodiments, a lining extends over the top surface of the sole to enhance comfort.

DETAILED DESCRIPTION OF THE INVENTION

Figure 1:
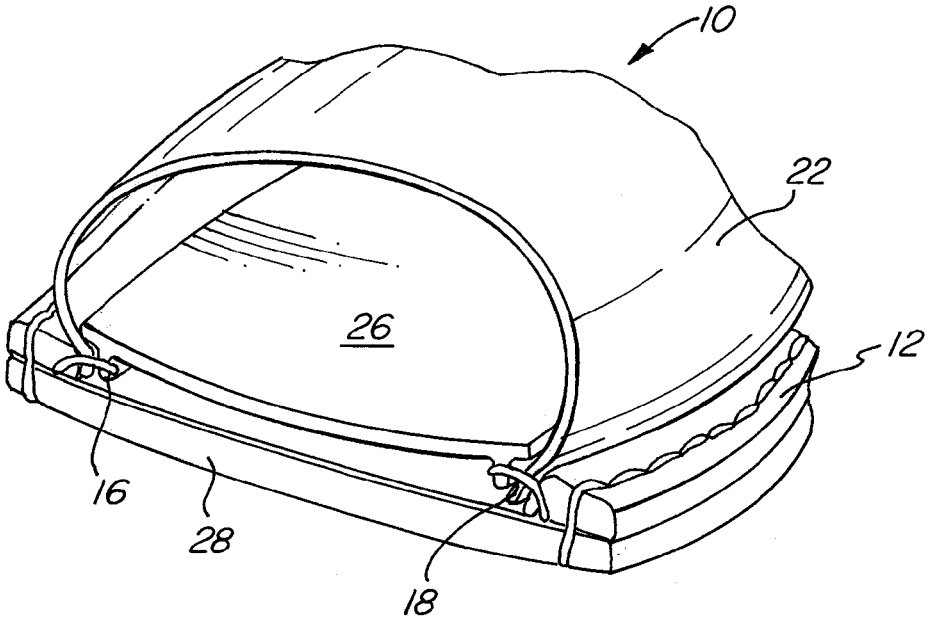
FIG. 1 PRIOR ART
FIG. 1 depicts a shoe known in the prior art.
Figure 2:
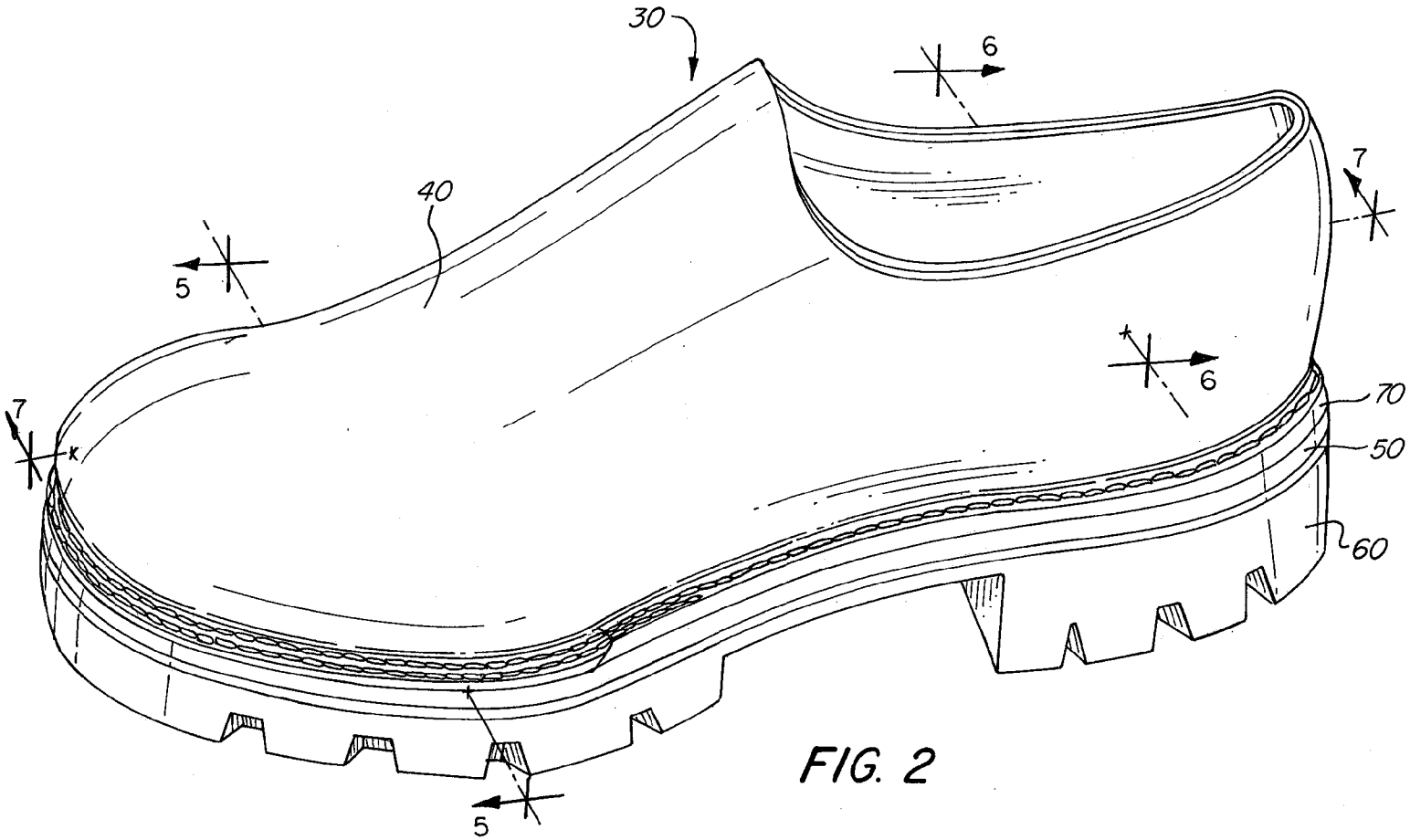
FIG. 2 depicts the shoe in accordance with the invention.
Figure 3:
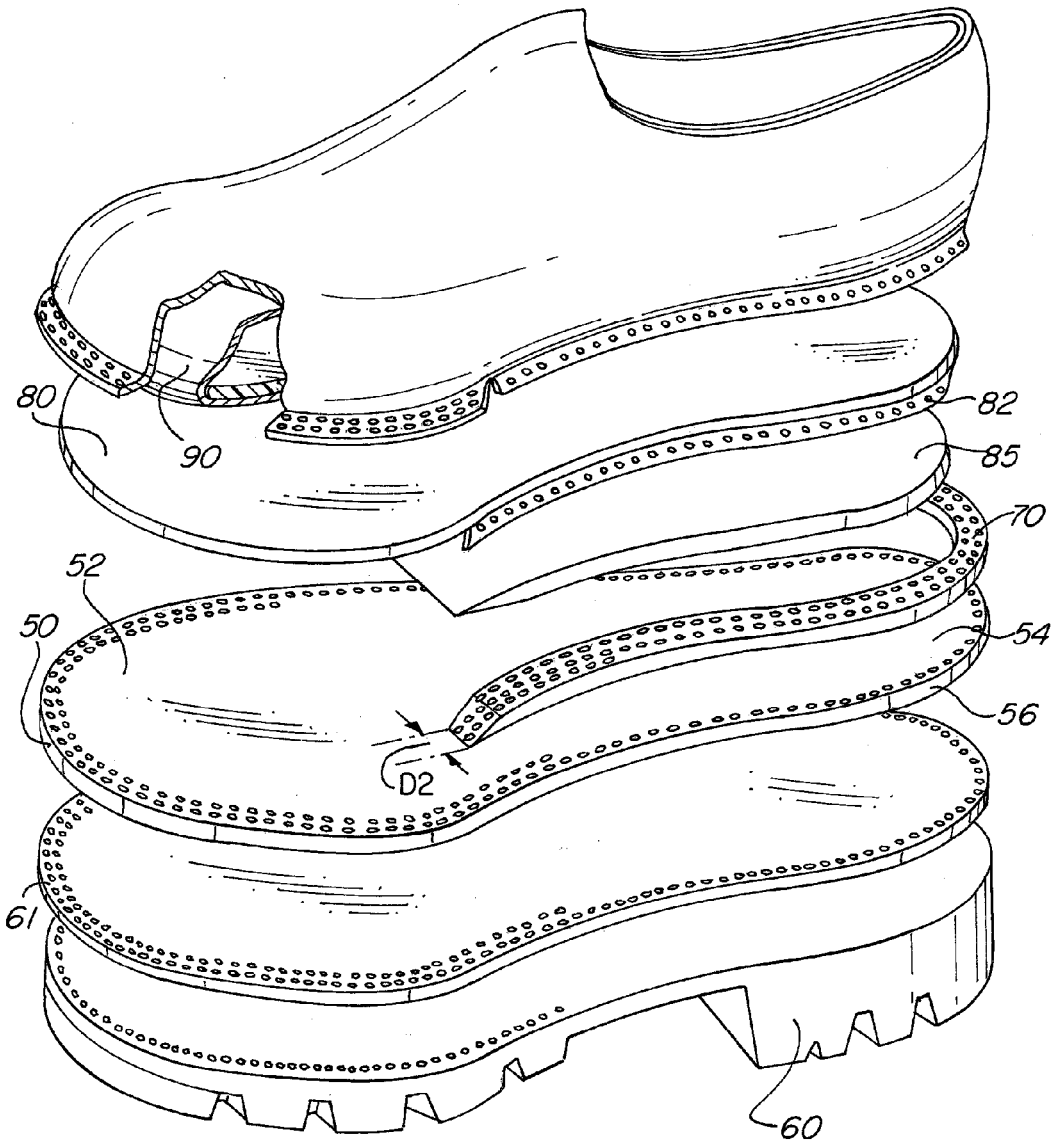
FIG. 3 more particularly depicts the layers of the shoe shown in FIG. 2.

FIGS. 2-3 depict shoe 30 in accordance with the invention, including upper 40, midsole 50, outsole 60, and welt 70.

Outsole 60 and midsole 50 are shown to extend the entire length of shoe 30 and each includes a first part and second part. More particularly, midsole 50 has a first part 52 in the fore area of midsole 50 and second part 54 in the rear area of midsole 50.

Insole 80 is shown to extend over the proximate area of second part 54, or from the rear of shoe 30 toward arch area 34. In other embodiments, insole 80 extends from second area 54 to first part 52, nearly covering or entirely covering midsole 50.

Welt 70 extends around a localized area of perimeter 56 of midsole 50, where the localized area is determined by how far rib 82 of insole 80 extends toward first part 52 from the rear of shoe 30. As shown in FIG. 3, welt 70 extends around perimeter 56 toward first part 52 in similar fashion as rib 82 extends toward first part 52. In further embodiments, welt 70 extends to a distance less than rib 82.

Figure 6:
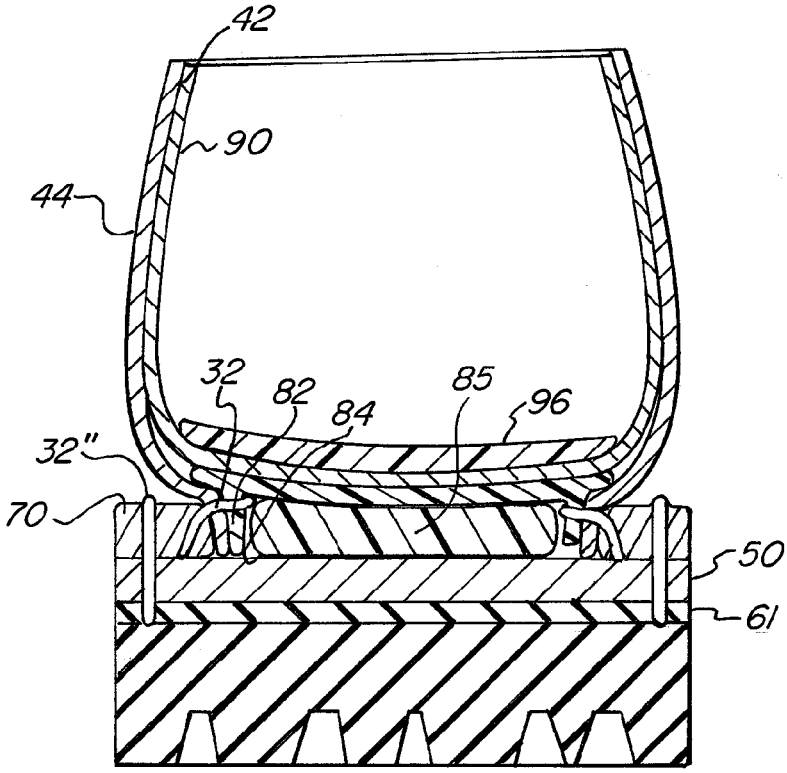
FIG. 6 depicts another cross sectional view of the shoe shown in FIG. 2.
Figure 7:
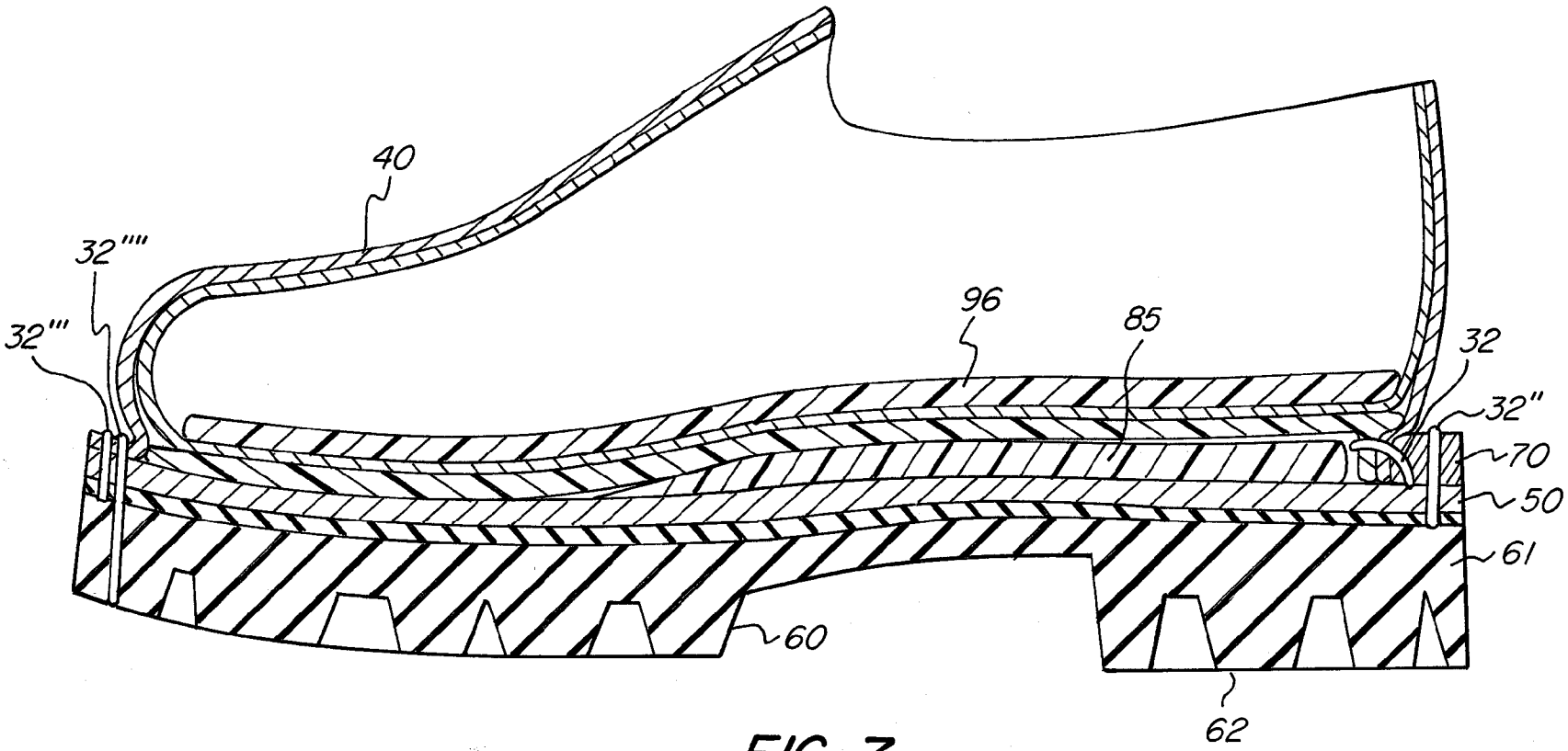
FIG. 7 depicts another cross sectional view of the shoe shown in FIG. 2.

As shown in FIG. 6, a cross sectional view through a rear area of shoe 30 is taken. Upper 40 is folded inwardly where outside 44 of upper is in contact with welt 70 and inside 42 of upper 40 is in contact with rib 82. First stitch 32 extends from innerside 84 of rib 82 through rib 82, upper 40, and welt 70. Second stitch 32" secures welt 70 to midsole 50 by extending from the top of welt 70 through welt 70 and midsole 50 and through top part 61 of outsole 60. The area between the two ribs 82 shown in FIG. 6 is filled with any type of material to support the user's foot, such as leather, fiber board, or cushioning material 85.

Figure 5:
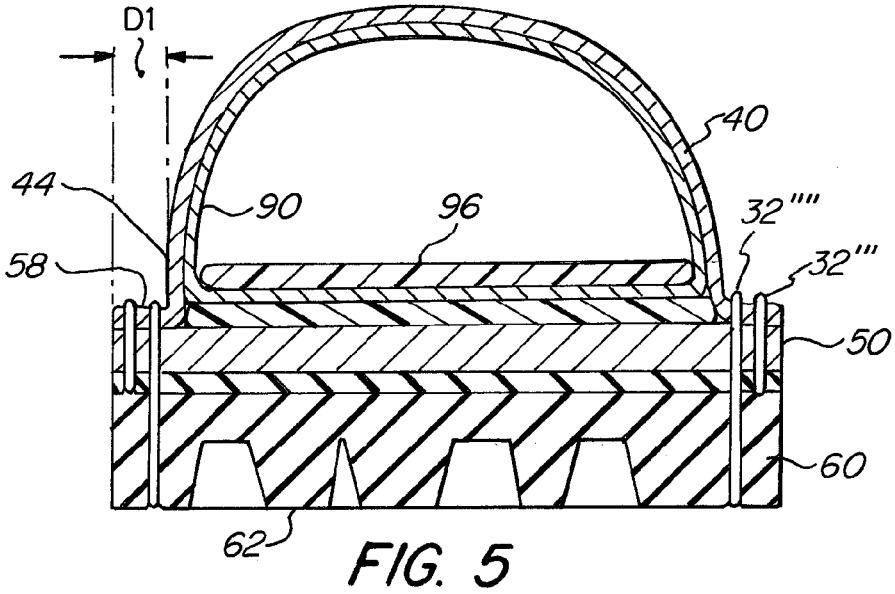
FIG. 5 depicts a cross sectional view of the shoe shown in FIG. 2.

As shown in FIG. 5, a cross sectional view through a fore area of shoe 30 is taken. FIG. 5 depicts upper 40 being folded outwardly where inside 42 of upper 40 is in contact with midsole 50, thereby defining flattened lip 58. Third stitch 32''' extends from outside 44 of upper 40 downwardly through upper 40 and midsole 50. Since midsole 50 is cemented to outsole 60, third stitch 32''' is not subjected to the wear normally encountered on bottom surface 62 of outsole 60 in either the fore area or rear area of shoe 30.

Fourth stitch 32'''' is shown to pass from outside 44 of upper 40 downwardly through upper 40, midsole 50, and outsole 60 to bottom 62 of outsole 60. As shown, third and fourth stitches 32''', 32'''' provide a double stitch appearance around lip 58 and first and second stitches 32, 32" provide a double stitch appearance around welt 70.

Because both the fore area and rear areas of shoe 30 utilize a stitching that extends downwardly into midsole 50, and because flattened lip 58 has a depth D1 commensurate with depth D2 of welt 70, the appearance of the construction of shoe 30 is similar as it transitions from fore area to rear area of shoe 30. It is understood that stitch 32 need not be continuous and need not have the same limitations in various areas of shoe 30.

Figure 4:
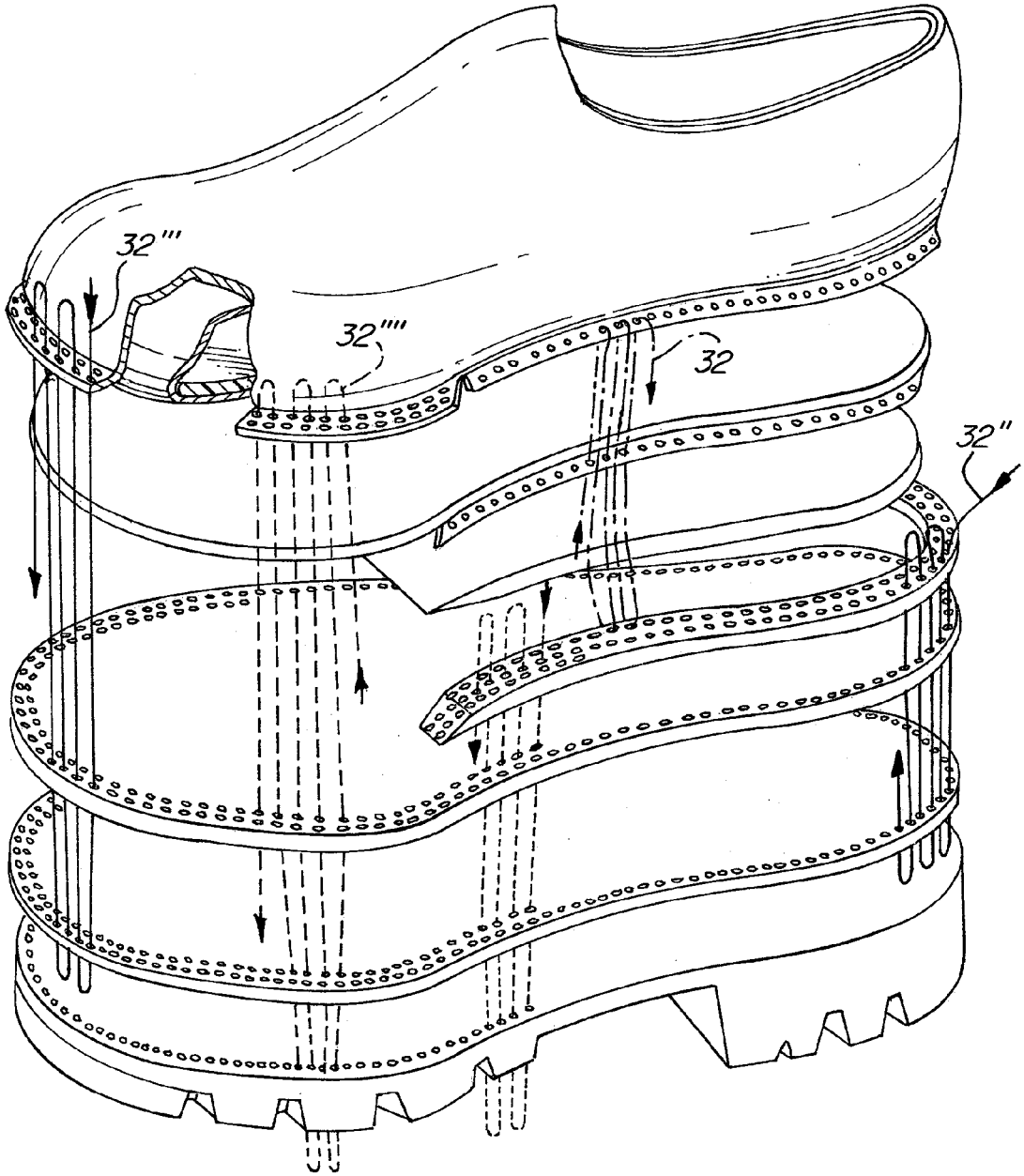
FIG. 4 more particularly depicts a stitching pattern shown in FIG. 2.

Optionally, shoe 30 also includes bootie 90 that lines inside 42 of upper 40. As shown in FIGS. 2-4, bootie 90 extends all over inside 42 of upper 40 for comforting a user's foot. In some of these embodiments, footbed 96 is placed within bootie 90 to further comfort the foot. Footbed 96 may be removable so that a different footbed may be used, which reduces bacteria since a new footbed would replace an old footbed. Also, changing footbeds permits the user to vary the cushioning if the new footbed has enhanced cushioning over the old footbed.

In some embodiments, footbed 96 is a lining of leather. In other embodiments, footbed 96 includes foam or resilient material in addition to leather or other comfortable material.

Figure 8:
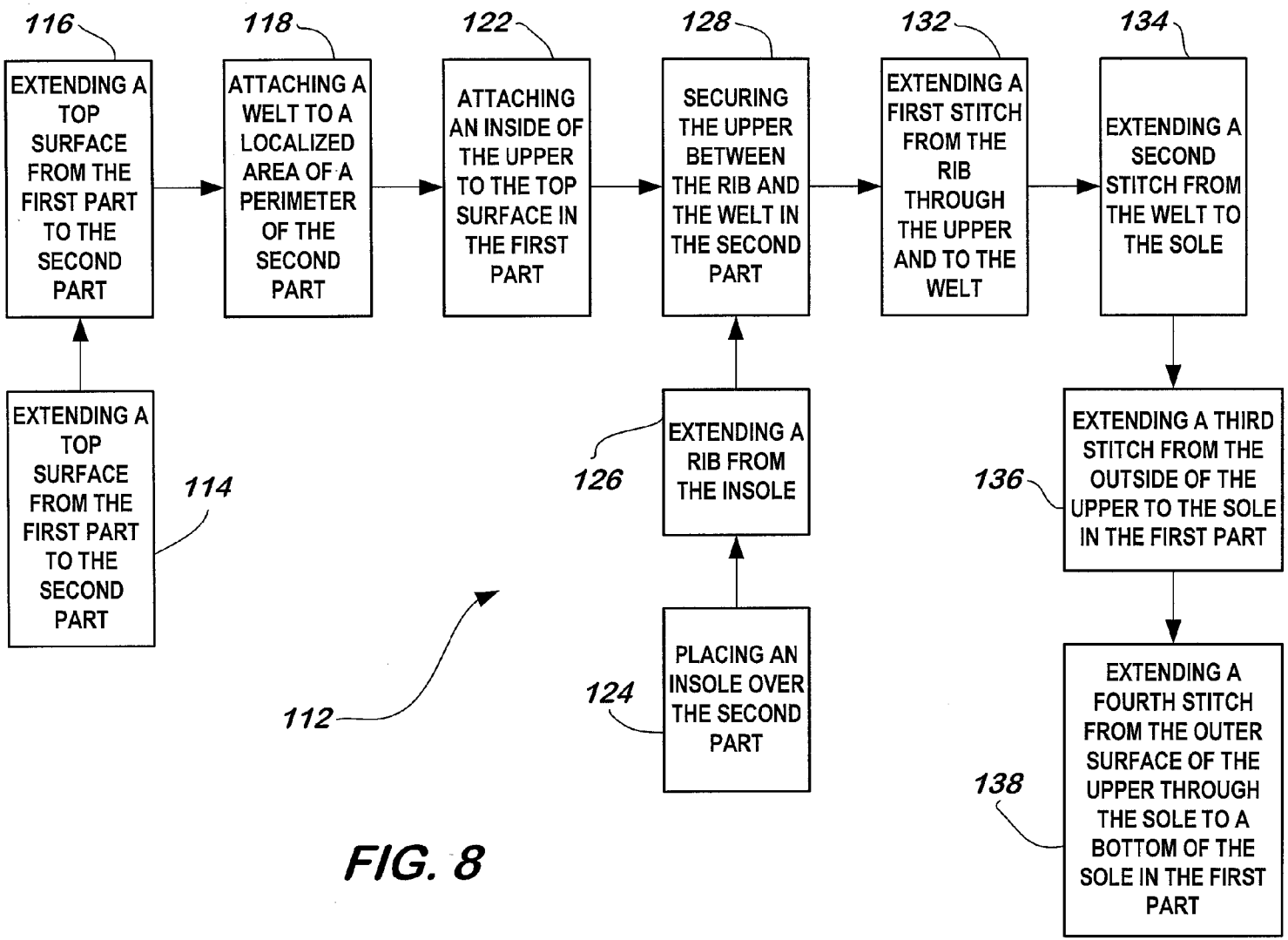
FIG. 8 depicts a method of providing the shoe shown in FIG. 2.

As shown in FIG. 8, method 112 includes the steps of providing 114 a sole having a first part and a second part and extending 116 a top surface from the first part to the second part.

Method 112 also includes attaching 118 a welt to a localized area of a perimeter of the second part and attaching 122 an inside of an upper to the top surface in the first part of the sole. Also as shown, the method places 124 an insole over the second part, extends 126 a rib downwardly from the insole, and secures 128 the upper between the rib and the welt in the second part of the sole where an outside of the upper is in contact with the welet.

To complete the shoe, method 112 includes extending 132 a first stitch from the rib through the upper and to the welt, extending 134 a second stitch from the welt to the sole, and extending 136 a third stitch from the outside of the upper to the sole in the first part to secure the inside of the upper to the first part.

In some embodiments, method 112 includes extending 138 a fourth stitch from the outer surface of the upper through the sole to a bottom of the sole in the first part for securing the upper to the first part.

What is claimed is:

1. A shoe, comprising:

a sole having a first part in a toe area, a second part in a heel area, and a top surface extending from said first part to said second part;

a welt attached to extending only along a perimeter of said second part;

an upper having an inside and an outside;

said outside is attached to said welt in said second part of said sole; and said inside is directly attached to said top surface in said first part of said sole.

2. The sole according to claim 1, wherein said sole is a midsole.

3. The sole according to claim 2, further comprising an outsole attached to said midsole.

4. The sole according to claim 1, further comprising a stitch extending from said outside of said upper to said sole in said first part.

5. The sole according to claim 1, further comprising a stitch extending from said welt to said sole in said second part.

6. The sole according to claim 1, further comprising a stitch extending from said inside of said upper through said welt and to said sole in said second part.

7. The sole according to claim 1, further comprising an insole with a rib and wherein said upper is attached to said rib.

8. The sole according to claim 1, wherein said inside of said upper is in contact with said first part around a perimeter of said first part, thereby defining a flattened lip.

9. The sole according to claim 8, wherein said flattened lip has a depth defined at least in part by an outermost perimeter and an innermost perimeter around said first part.

10. The sole according to claim 8, wherein said welt has a depth similar to said flattened lip.

11. A shoe, comprising:

a sole having a first part, a second part, and a top surface extending from said first part to said second part;

a welt attached to a localized area of a perimeter of said second part;

an upper having an inside and an outside;

said inside is directly attached to said top surface in said first part of said sole;

an insole placed over said second part, said insole having a rib where said upper is attached to said rib;

said upper is in between said welt and said rib in said second part of said sole and where said outside is in contact with said welt;

a first stitch extending from said rib through said upper and to said welt;

a second stitch extending from said welt to said sole; and a third stitch extending from said outside of said upper to said sole in said first part to secure said inside of said upper to said first part.

12. The sole according to claim 11, further comprising a fourth stitch extending from said outer surface of said upper through said sole to a bottom of said sole in said first part for securing said upper to said first part.

13. The sole according to claim 1, further comprising a lining extending over said top surface of said sole.

14. A method of providing a shoe, comprising the steps of:

providing a sole having a first part and a second part;

extending a top surface from the first part to the second part;

attaching a welt to a localized area of a perimeter of the second part;

attaching an inside of an upper directly to the top surface in the first part of the sole;

placing an insole over the second part;

extending a rib downwardly from the insole;

securing the upper between the rib and the welt in the second part of the sole and where an outside of the upper is in contact with the welt;

extending a first stitch from the rib through the upper and to the welt;

extending a second stitch from the welt to the sole; and extending a third stitch from the outside of the upper to the sole in the first part to secure the inside of the upper to the first part.

15. The method according to claim 14, further comprising the step of extending a fourth stitch from the outer surface of the upper through the sole to a bottom of the sole in the first part for securing the upper to the first part.

* * * * *